US012097998B2

(12) United States Patent
Dreyer et al.

(10) Patent No.: US 12,097,998 B2
(45) Date of Patent: Sep. 24, 2024

(54) CLOSURE

(71) Applicant: Obrist Closures Switzerland GmbH, Reinach (CH)

(72) Inventors: Lino Dreyer, Reinach (CH); Graeme Hood, Reinach (CH); Alexandre Rouquette, Reinach (CH); Sebastien Widmer, Reinach (CH)

(73) Assignee: Obrist Closures Switzerland GmbH, Reinach (CH)

( * ) Notice: Subject to any disclaimer, the term of this patent is extended or adjusted under 35 U.S.C. 154(b) by 231 days.

(21) Appl. No.: 17/629,580

(22) PCT Filed: Oct. 18, 2019

(86) PCT No.: PCT/EP2019/078398
§ 371 (c)(1),
(2) Date: Jan. 24, 2022

(87) PCT Pub. No.: WO2021/013370
PCT Pub. Date: Jan. 28, 2021

(65) Prior Publication Data

US 2022/0267052 A1 Aug. 25, 2022

(30) Foreign Application Priority Data

Jul. 23, 2019 (GB) ..... 1910507

(51) Int. Cl.
*B65D 41/34* (2006.01)
*B65D 55/16* (2006.01)

(52) U.S. Cl.
CPC ..... *B65D 41/3447* (2013.01); *B65D 55/16* (2013.01); *B65D 2401/30* (2020.05)

(58) Field of Classification Search
CPC . B65D 41/3447; B65D 55/16; B65D 2401/30
See application file for complete search history.

(56) References Cited

U.S. PATENT DOCUMENTS 3,986,627 A 10/1976 Zapp
5,215,204 A 6/1993 Beck et al.
(Continued)

FOREIGN PATENT DOCUMENTS

CA 2055210 A1 5/1993
CN 1830730 A 9/2006
(Continued)

OTHER PUBLICATIONS

Examination Report for Chinese Patent Application No. 20198098664, mailed Feb. 15, 2023.
(Continued)

*Primary Examiner* — James N Smalley
(74) *Attorney, Agent, or Firm* — C. Brandon Browning; Ilya S. Mirov; Maynard Nexsen PC

(57) ABSTRACT

A closure for a container is provided. The closure comprises a cap and a retaining ring arranged under the cap for retaining the closure on the container in use. The cap and ring are joined by a pair of connecting arms. A first arm is non-frangibly connected to the cap at a cap tether end and circumferentially anticlockwise therefrom is non-frangibly connected to the ring at a ring root end. A second arm is non-frangibly connected to the cap at a cap tether end and circumferentially clockwise therefrom is non-frangibly connected to the ring at a ring root end. The cap can be tilted away from the ring with the arms providing a hinge-like function, and each of the arms twists between its cap tether end and its ring root end, whereby tension is generated in the arms.

10 Claims, 13 Drawing Sheets

(56) References Cited

U.S. PATENT DOCUMENTS

Figure 1:
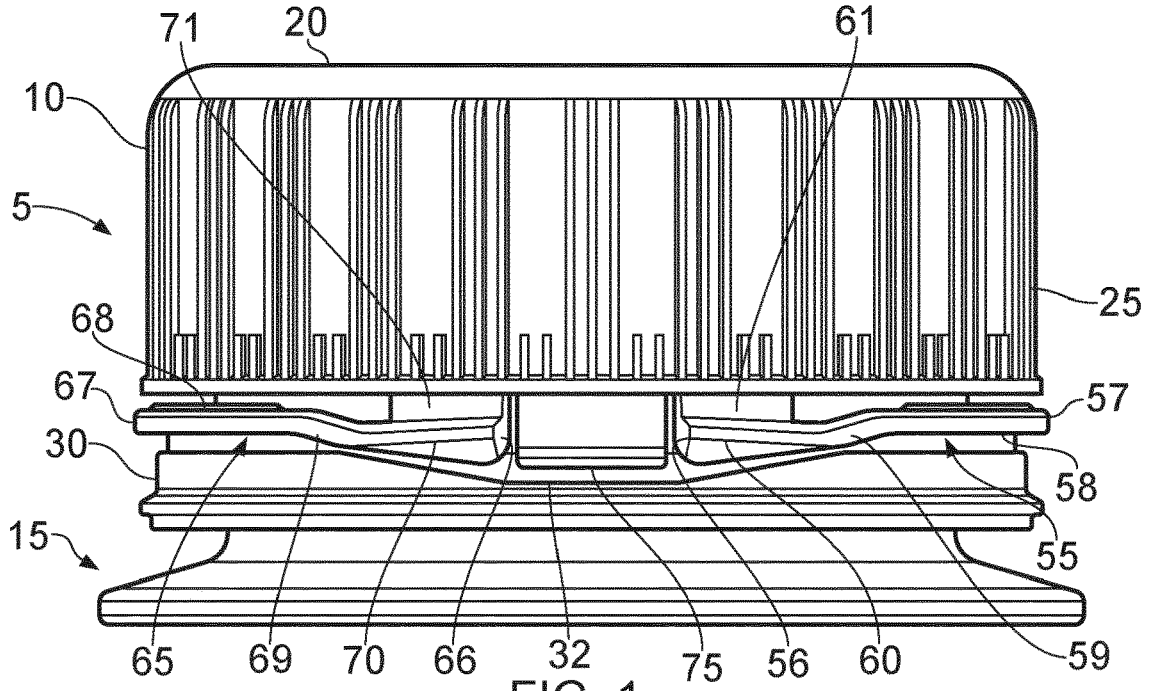

| | | | | |
|---|---|---|---|---|
| 5,246,125 | A | 9/1993 | Julian | |
| 8,807,360 | B2 * | 8/2014 | Erspamer | B65D 41/3428 220/276 |
| 2011/0114593 | A1 * | 5/2011 | Ishii | B65D 41/325 215/253 |
| 2019/0168935 | A1 | 6/2019 | Wang et al. | |

FOREIGN PATENT DOCUMENTS

| | | | |
|---|---|---|---|
| CN | 101412450 | A | 4/2009 |
| CN | 101553412 | A | 10/2009 |
| CN | 108473239 | A | 8/2018 |
| CN | 109383920 | A | 2/2019 |
| CN | 109625578 | A | 4/2019 |
| CN | 109937182 | A | 6/2019 |
| DE | 9318243 | U1 | 2/1994 |
| GB | 2068913 | A | 8/1981 |
| KR | 10-0880006 | B1 | 1/2009 |
| WO | 0026108 | A1 | 5/2000 |
| WO | 2019207153 | A2 | 10/2019 |

OTHER PUBLICATIONS

Jacques Fournier, "International Search Report and Written Opinion for PCT/EP2019/078398," International Searching Authority; Jul. 24, 2020.

Giuseppe Di Miceli, "International Preliminary Report on Patentability," International Preliminary Examining Authority; Oct. 19, 2021.

* cited by examiner

CLOSURE

CROSS-REFERENCE TO RELATED APPLICATIONS

This application is a national stage under 35 U.S.C. 371 of International Application No. PCT/EP2019/078398 having an international filing date of Oct. 18, 2019. International Application No. PCT/EP2019/078398 cites the priority of GB Patent Application No. 1910507.1, filed Jul. 23, 2019.

The present invention relates generally to a tethered closure cap and particularly, although not exclusively to a tamper-evident tethered closure.

Arranged on the lower edge of the cap wall of closure caps of this type is a retaining ring that engages beneath a bead on a container mouth when the closure cap is in position. On opening the container, only the upper cap portion is removed, while the lower retaining ring remains firmly connected to the container mouth.

A tether connects the retaining ring with the cap wall so that the cap will remain connected with the container and cannot be mislaid or discarded separately.

The retaining ring is simultaneously used as an anti-tamper ring for the display of initial opening of the container. To this end, the retaining ring may, for example, connected by means of frangible bridges with the lower edge of the cap wall. The retaining ring can slide over the bead on the container mouth on initial fitting of the closure cap without risk to the bridges; and the ring subsequently holds securely on the container mouth.

The retaining ring of such a closure cap may have one or more tongues protruding radially inwardly on its inside surface, said tongues extending towards the cap base and engaging beneath the bead on the container mouth when the closure cap is in position on the container mouth. The tongue/s are connected only at one end with the retaining ring, and their free end is able to pivot in a radial direction. On initial fitting of the closure cap, the tongue/s can therefore be pivoted outwards in the radial direction when they slide over the bead onto the container mouth.

An aspect of the present invention provides a closure for a container, the closure comprising a cap and a retaining ring arranged under the cap for retaining the closure on the container in use, the cap and ring are joined by a pair of connecting arms, a first arm is non-frangibly connected to the cap at a cap tether end and circumferentially anticlockwise therefrom is non-frangibly connected to the ring at a ring root end, a second arm is non-frangibly connected to the cap at a cap tether end and circumferentially clockwise therefrom is non-frangibly connected to the ring at a ring root end, the cap can be tilted away from the ring with the arms providing a hinge-like function, and each of the arms twists between its cap tether end and its ring root end, whereby tension is generated in the arms.

In addition to the twisting in the arm there may also be some bending/hinging/flexing in the region of the tether ends and/or the root ends of the arms.

The cap tether ends may be circumferentially spaced.

A tab may be provided between the cap tether ends. For example in some embodiments a tab is provided and is separated from cap tether ends of the arms by cuts/gaps.

In some embodiments the tab depends from the cap, for example from the free end of the sidewall.

The tab may be generally rotated/inverted as the cap is tilted away from the ring and may rest on the container to hold the cap in an open position. For example the tab may rest/lean/wedge/abut on a container neck.

The present invention also provides a carbonated beverage closure comprising a cap and a retaining ring, the cap comprises a top plate and a sidewall that depends from the periphery of the top plate, the retaining band is provided at the free end of the sidewall, the retaining ring comprises two connecting arms, each of the arms is non-frangibly connected to the free end of the sidewall.

An aspect of the present invention provides a carbonated soft drinks (CSD) closure, the closure comprising a shell and a tamper-evident band arranged under the shell for retaining the closure on a container in use, the shell and band are joined by a pair of connecting arms, a first arm is non-frangibly connected to the shell at a shell tether end and circumferentially anticlockwise therefrom is non-frangibly connected to the band at a band root end, a second arm is non-frangibly connected to the shell at a shell tether end and circumferentially clockwise therefrom is non-frangibly connected to the band at a band root end, the shell can be tilted away from the band with the arms providing a hinge-like function, and each of the arms twists between its shell tether end and its band root end, whereby tension is generated in the arms.

An aspect of the present invention provides a carbonated soft drinks (CSD) closure, the closure comprising a shell and a tamper-evident band arranged under the shell for retaining the closure on a container in use, the shell and band are joined by a pair of connecting arms so that the shell can be tilted away from the band with the arms providing a hinge-like function, in which the connecting arms are provided entirely in/by the band and not at all in/by the shell.

In some embodiments torsion is transferred to the arms when the cap is opened.

The connecting arms may comprise a first arm and a second arm, the first arm is non-frangibly connected to the cap at a cap tether end and circumferentially anticlockwise therefrom is non-frangibly connected to the ring at a ring root end, the second arm is non-frangibly connected to the cap at a cap tether end and circumferentially clockwise therefrom is non-frangibly connected to the ring at a ring tether end, the cap can be tilted away from the ring with the arms providing a hinge-like function, and each of the arms twists between its cap tether end and its ring root end, whereby tension is generated in the arms.

The cap may comprise a top plate and a sidewall which depends from the top plate.

The sidewall may be generally cylindrical.

The top plate may be generally disc shape.

The axial extent of the sidewall may be generally constant. In other words the sidewall may be the same length all way around.

In some embodiments a tab is provided between the arms.

The tab may depend from the cap, for example from the free end of a sidewall.

The tab may be frangibly connected to the ring, for example by one or more frangible bridges.

In some embodiments the tab is generally inverted as the cap is tilted away from the ring and may rest on the container to hold the cap in an open position.

The sidewall comprises engagement means for engaging a container, for example a screw thread formation. The formation may, for example, include one or more vents slots.

The ring may be fitted to be freely rotatable on the container.

The sidewall and the ring may be frangibly connected to each other. One or more frangible connections, for example frangible bridges, may be provided between the arms and the ring and/or sidewall.

In some embodiments the arms do not extend into the sidewall. This may be important, for example, in carbonated beverage closures in which the integrity of the sidewall cannot be compromised.

In some embodiments the arms include an inclined portion.

The arms may be non-frangibly to the free end of the sidewall.

The arms may be connected to the shell/cap in such a way to provide a bending/hinging function between the arms and the cap/shell.

The arms may be non-frangibly to the free end of the sidewall by thinned webs. The webs may provided for a bending/hinging function between the arms and the cap/shell.

The present invention also relates to a capping device comprising means for preventing the complete separation of a container and of the cap closing the container.

A further aspect provides a capping device comprising: a cap, the lateral skirt of which is equipped with means for its engagement with a container, it being possible for this cap, in one position, to be placed over the opening of the container so as to close this container and, in another position, to be released from this opening so as to allow access to the inside of the container; a ring engaged on that part of the container which delimits the said opening and held axially on it; and two arms in the form of an arc of a circle, each one of which is connected to the lateral skirt on the one hand and to the ring on the other hand, the arms being connected to the ring at locations which are angularly distant with respect to the locations at which they are connected to the skirt, the cap is movable from a closed position, in which the arms are close to the ring and in which the cap is axially close to the ring, and an open position, in which the arms are twisted and, by means of their length, allow the cap to be brought into a position which is axially remote from the ring, this position being sufficient to make it possible to release the said means for engaging the cap with the container and to tilt the said cap outwards with respect to this container so as to bring this cap into the position in which it is released from the opening of the container.

In some aspects and embodiments the cap can be moved to a stable open position, for example approximately 130-140 degrees with respect to the closed position.

The present invention also provides a capping device or closure as described herein, in which the arms hinge or bend with respect to the sidewall as the cap tilts.

The present invention also provides a capping device or closure as described herein in combination with a container.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims. Each aspect can be carried out independently of the other aspects or in combination with one or more of the other aspects.

The present invention will now be more particularly described, by way of example, with reference to the accompanying drawings.

The example embodiments are described in sufficient detail to enable those of ordinary skill in the art to embody and implement the systems and processes herein described. It is important to understand that embodiments can be provided in many alternative forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate.

Unless otherwise defined, all terms (including technical and scientific terms) used herein are to be interpreted as is customary in the art. It will be further understood that terms in common usage should also be interpreted as is customary in the relevant art and not in an idealised or overly formal sense unless expressly so defined herein.

In the following description, all orientational terms, such as upper, lower, radially and axially, are used in relation to the drawings and should not be interpreted as limiting on the invention.

Figure 2:
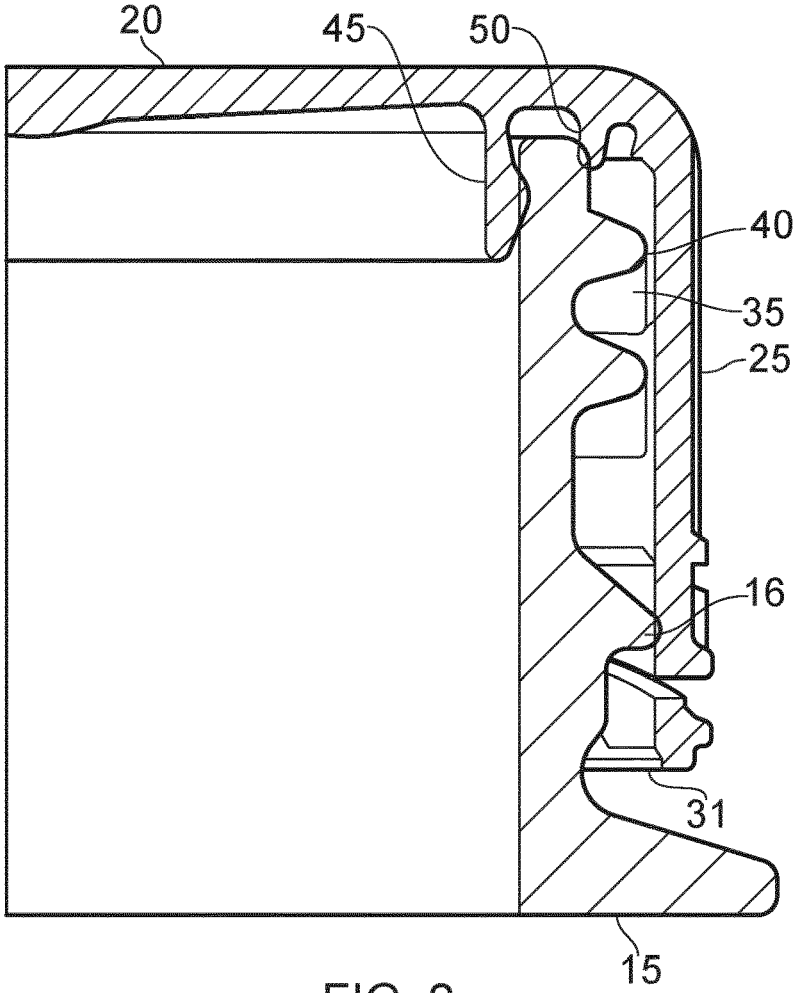
Figure 3:
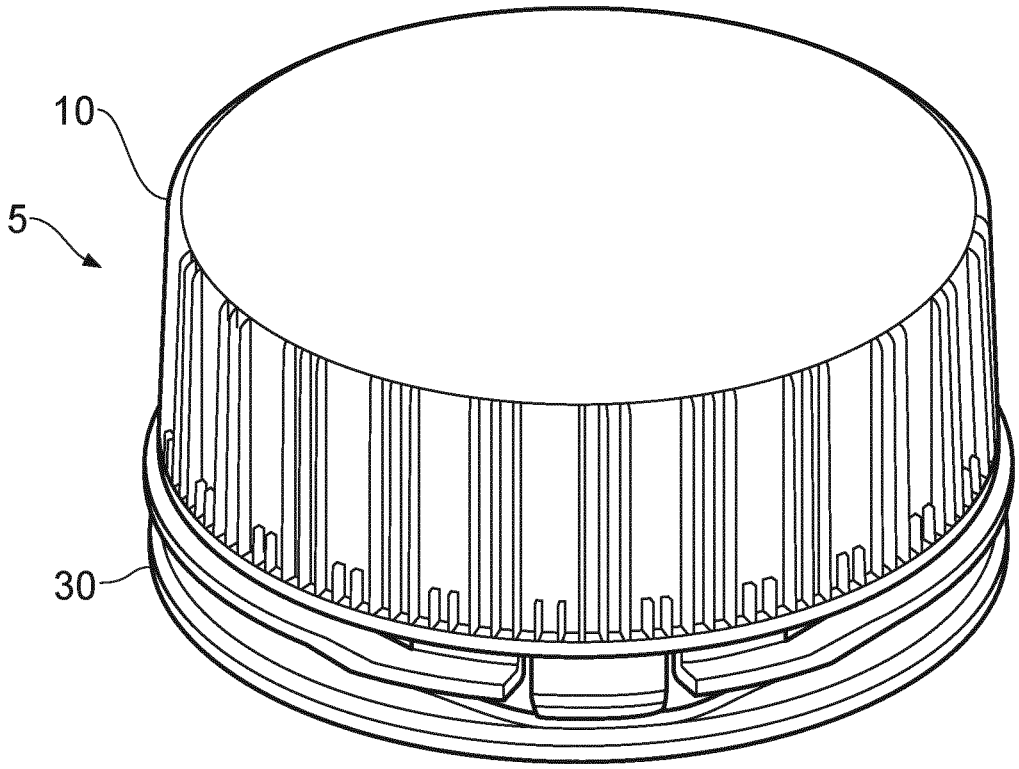
Figure 4:
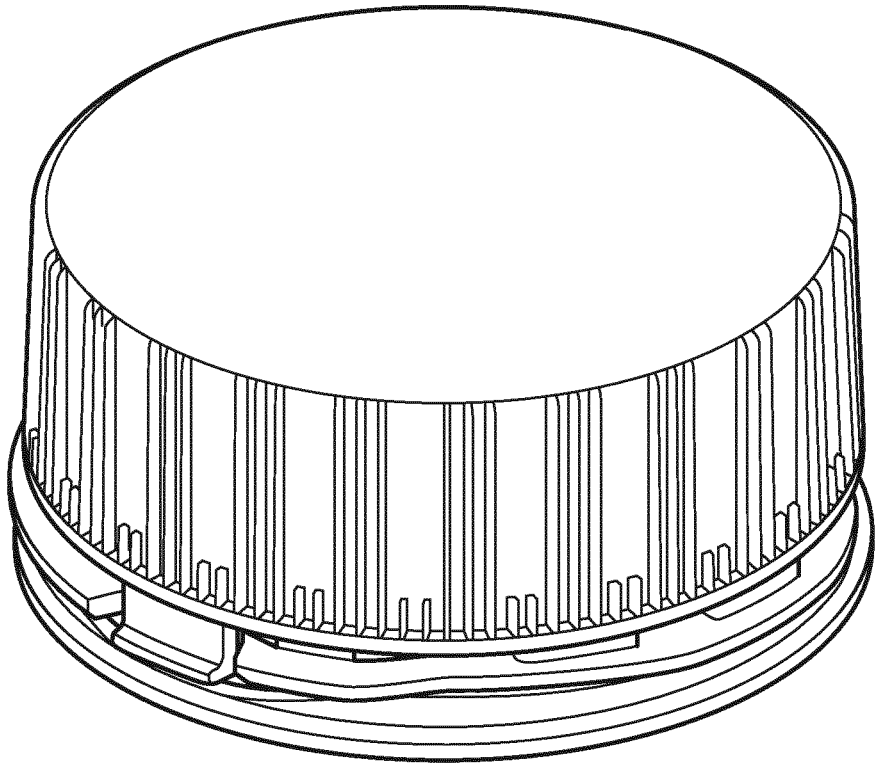
Figure 5:
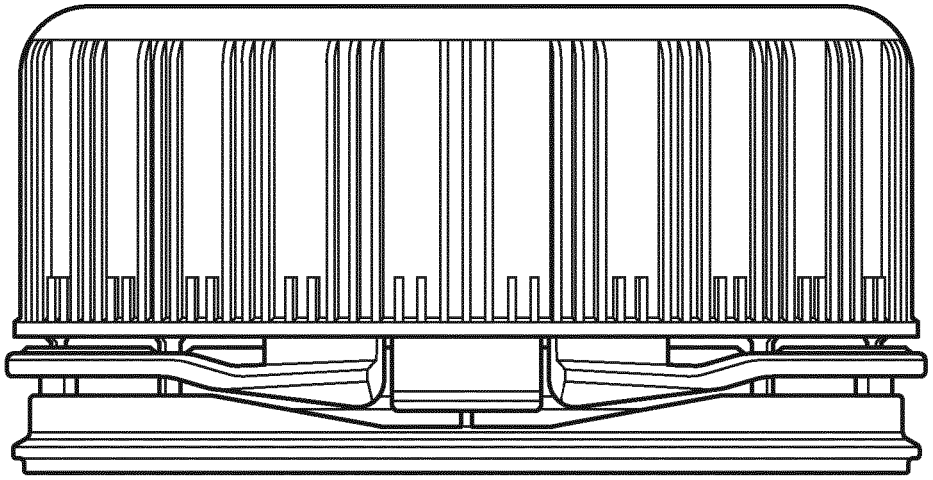
Figure 6:
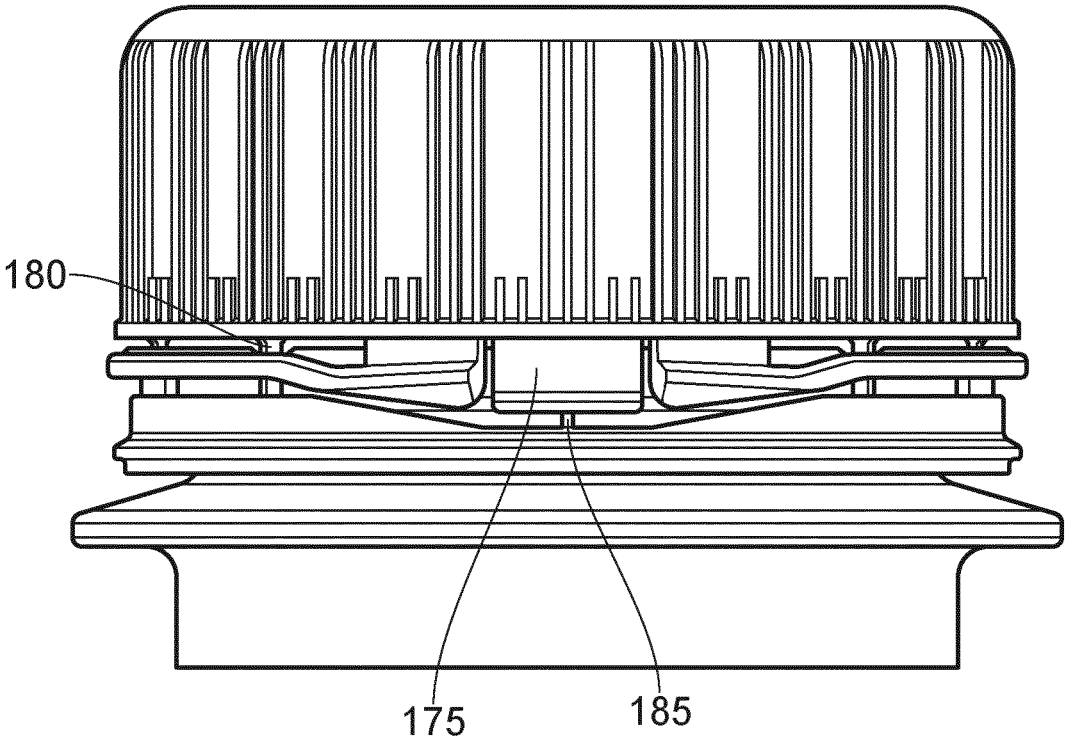

Referring first to FIGS. 1 and 2 there is shown a closure generally indicated 5 and connected to a container neck 15.

The closure 5 comprises cap 10 and a retaining ring 30.

The cap 10 comprises a top plate 20 and a sidewall 25 that depends from the periphery of the top plate. "Under" the sidewall, at the free end thereof the retaining ring 30 is provided.

The interior of the sidewall 25 includes a screw thread formation 35 that engages a corresponding formation 40 on the neck 15.

An internal annular seal 45 depends from the underside of the top plate 20 and fits into the bore of the neck when the closure is in place and the cap 10 is closed. An external annular seal 50 also depends from the underside of the top plate 20 and fits onto the outside of the neck when the closure is in place and the cap 10 is closed.

The ring 30 includes an internal annular snap bead 31 which is positioned under a neck bead 16 to prevent the ring from being removed axially.

The retaining ring 30 comprises a first connecting arm 55 and a second connecting arm 60.

The first arm 55 is non-frangibly connected to the cap at a cap tether end 56 and circumferentially anticlockwise therefrom is non-frangibly connected to the ring at a ring root end 57.

The second arm 65 is non-frangibly connected to the cap at a cap tether end 66 and circumferentially clockwise therefrom is non-frangibly connected to the ring at a ring root end 67.

In this embodiment each arm 55, 60 is formed as a first linear portion 58, 68 that extends from the root end 57, 67, an inclined portion 59, 69, and a second linear portion 60, 70. The second linear portions 60, 70 connect non-frangibly to the free end of the sidewall by thinned webs 61, 71.

Between the cap tether ends of the arms a central tab 75 is provided. The ring 30 has a cut-out 32 to accommodate the portions 60 and the tab 75.

As described in more detail below, the cap can be tilted away from the ring with the arms providing a hinge-like function, and each of the arms 55, 60 twists between its cap tether end 56, 66 and its ring root end 57, 67, whereby tension is generated in the arms. The position of the "hinge" provided by the arms is 100% in the tamper-evident band/retaining ring structure i.e. not in the closure shell.

During the unscrewing the closure can lift vertically along the thread helix, to allow freedom to get access to a container, while still remaining tethered thereto.

Referring now to FIGS. 3 to 6 there is shown a carbonated soft drink closure 105 formed according to a further embodiment. The closure is similar to the closure 5.

In this embodiment the arms 155, 160 are frangible connected to the sidewall and to the by frangible bridges 180. In addition the central tab 175 is connected to the ring 130 by a bridge 185.

Operation of a closure 205 formed in accordance with the present invention is shown in FIGS. 7 to 13.

Figure 7:
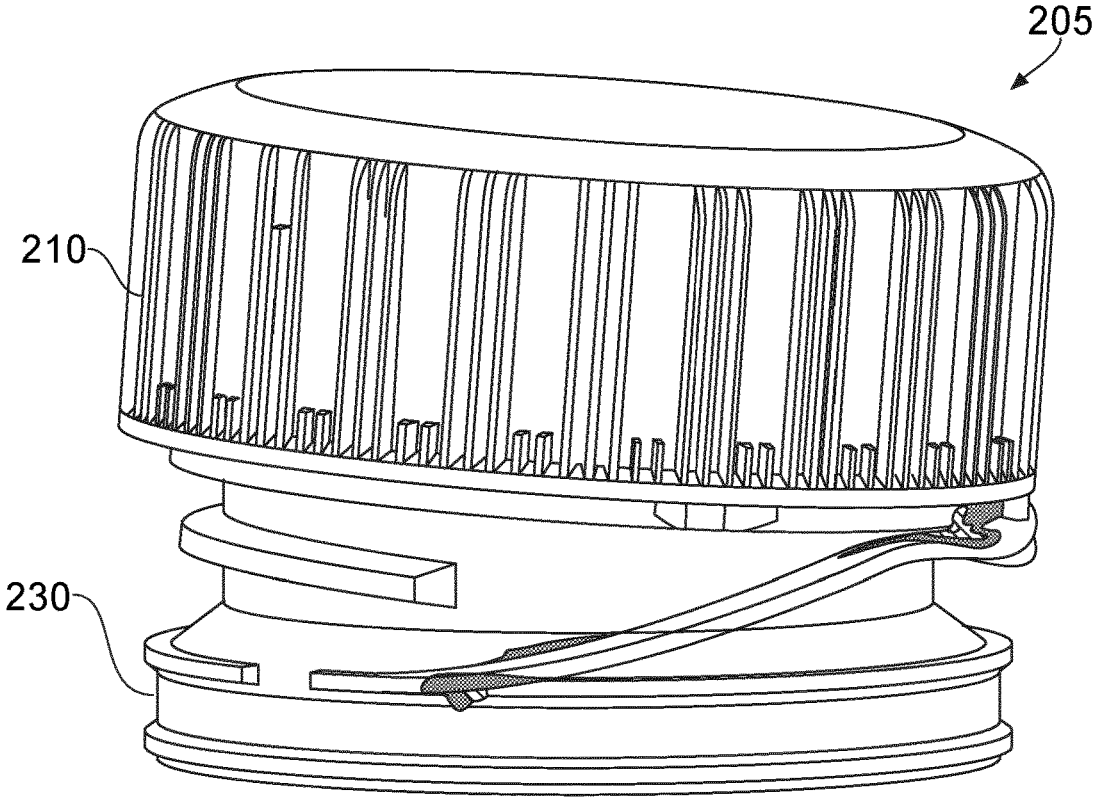
Figure 8:
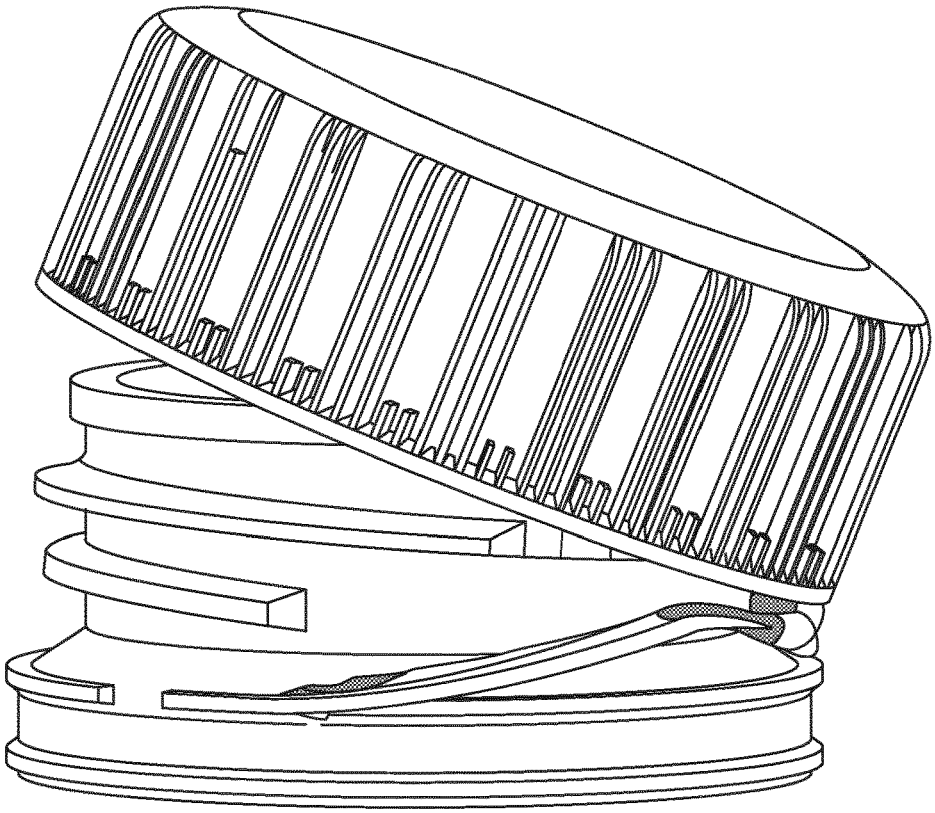

During the unscrewing the cap 210 can lift vertically along the thread helix while still remaining tethered thereto by the ring 230 (FIGS. 7 and 8).

Figure 9:
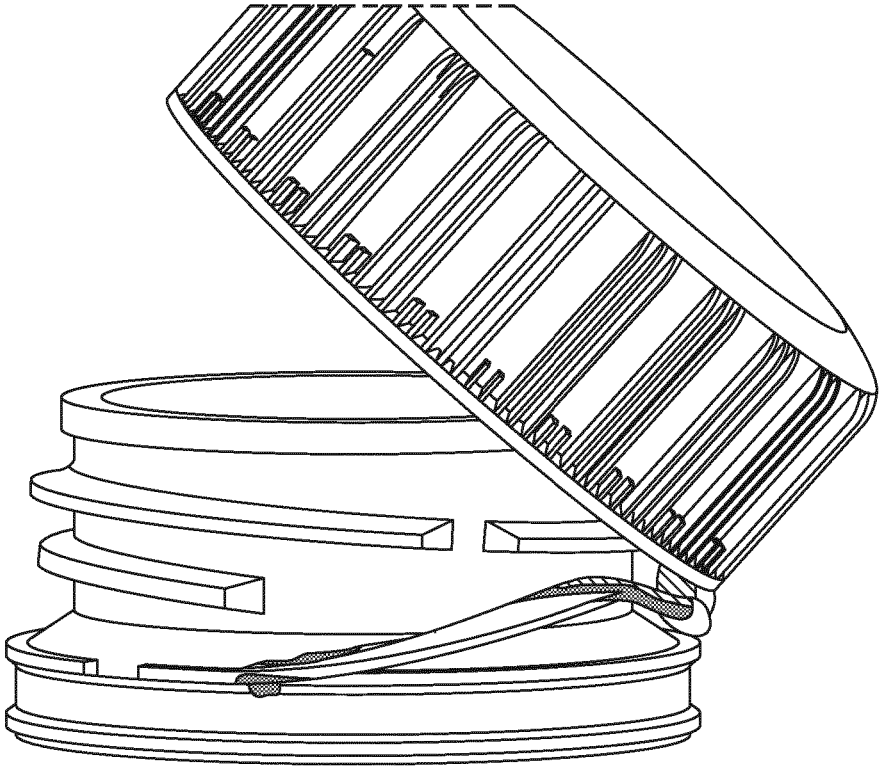
Figure 10:
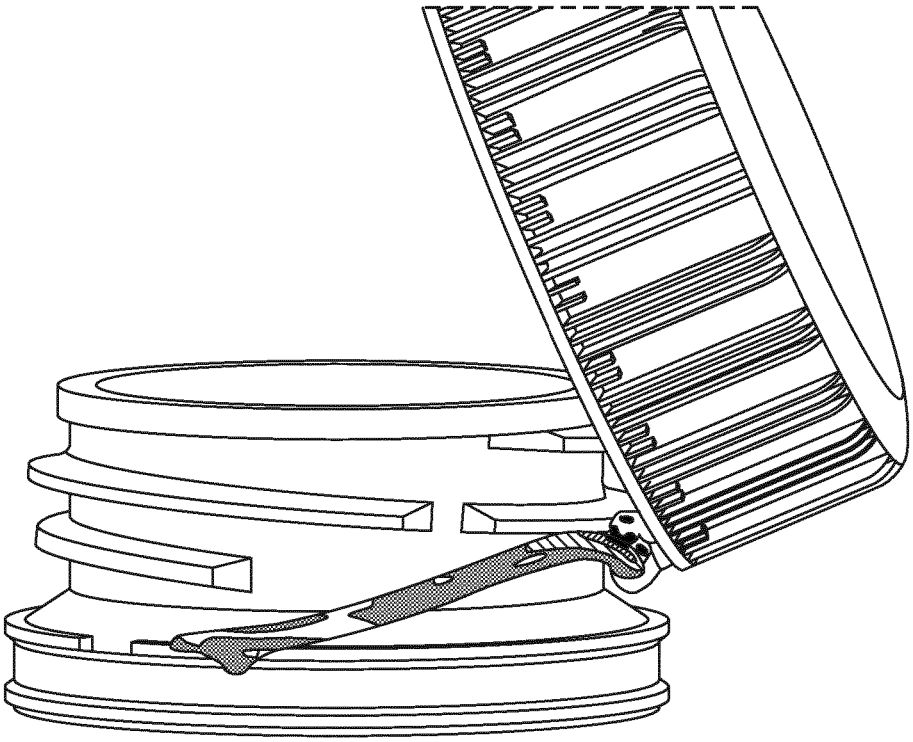

Once the screw threads have disengaged the cap can be tilted away from the ring (FIGS. 9 and 10).

Figure 11:
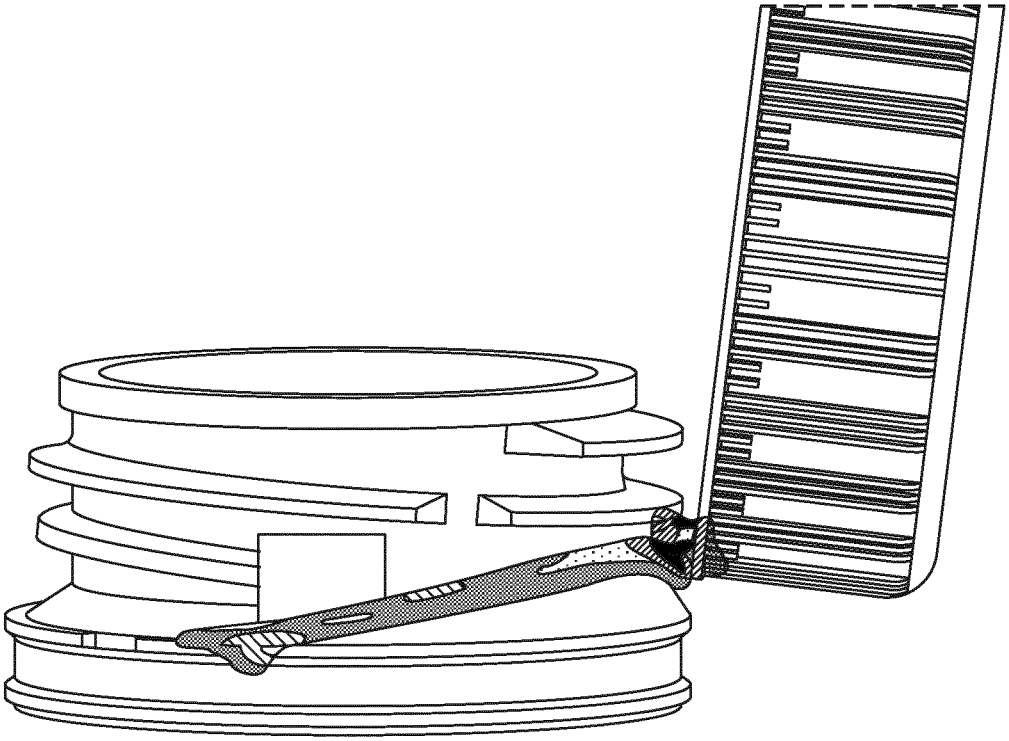
Figure 12:
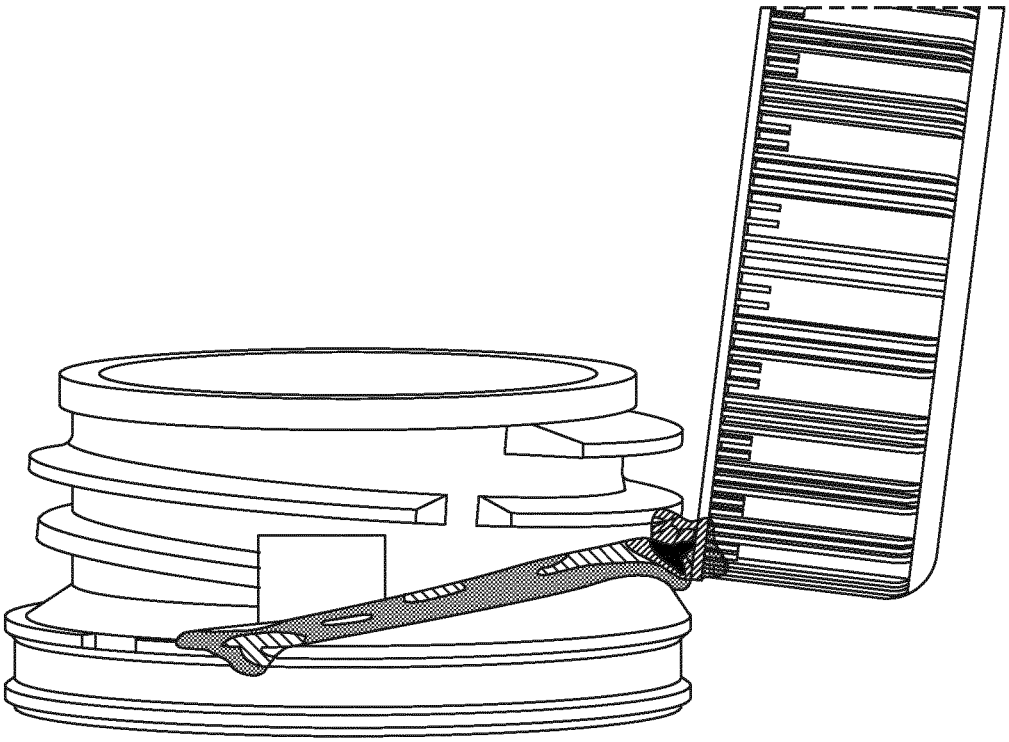

As the cap tilts the arms are twisted and the tab begins to invert (FIGS. 11 and 12).

Figure 13:
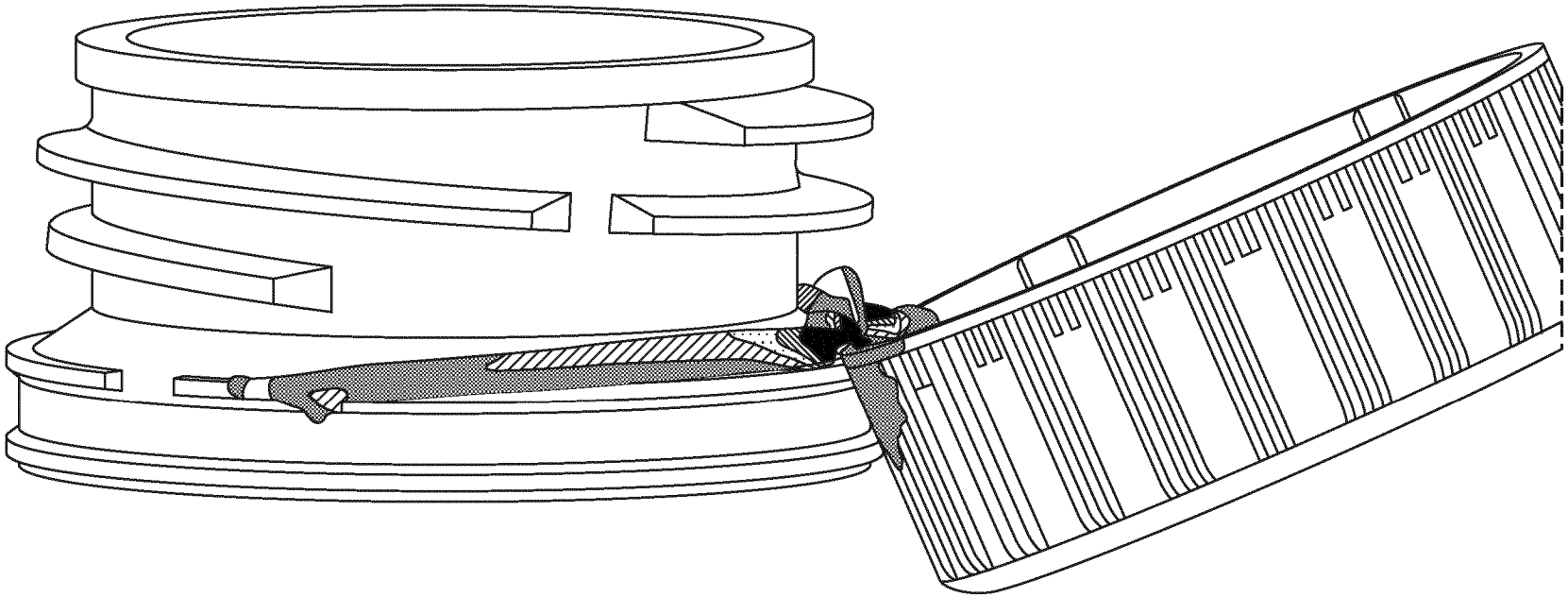
Figure 14:
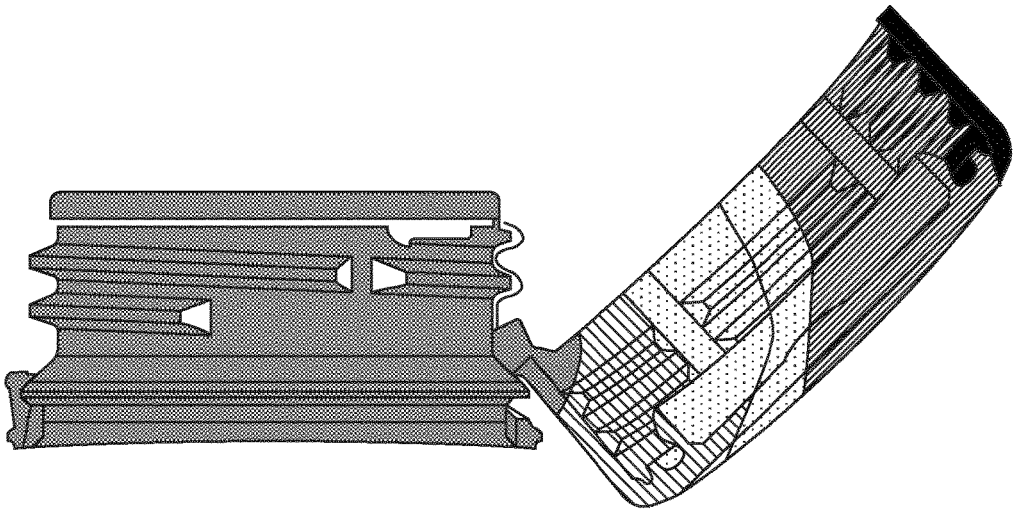
Figure 15:
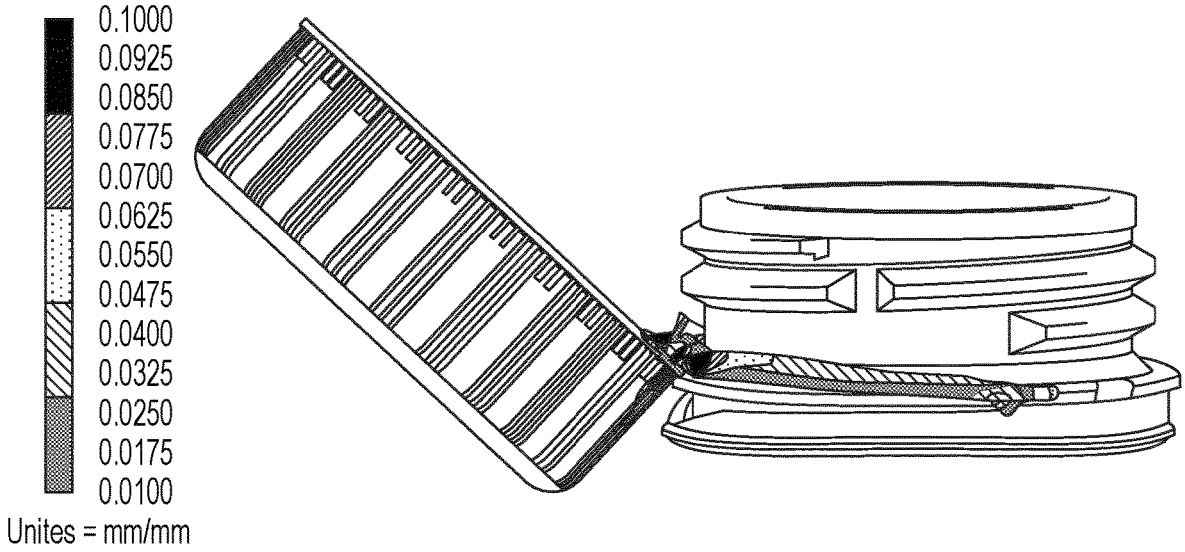
Figure 16:
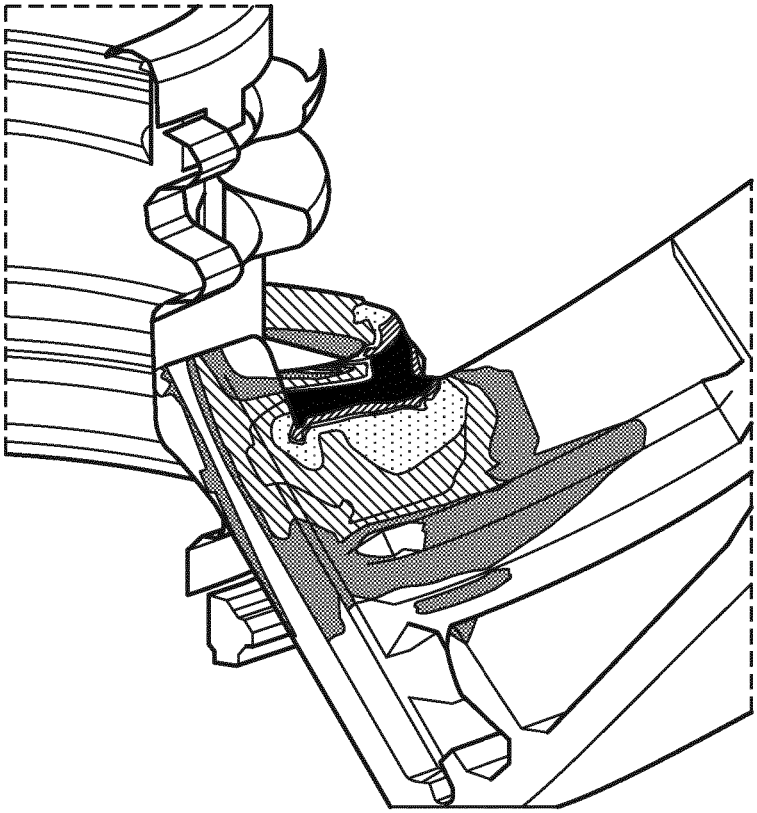
Figure 17:
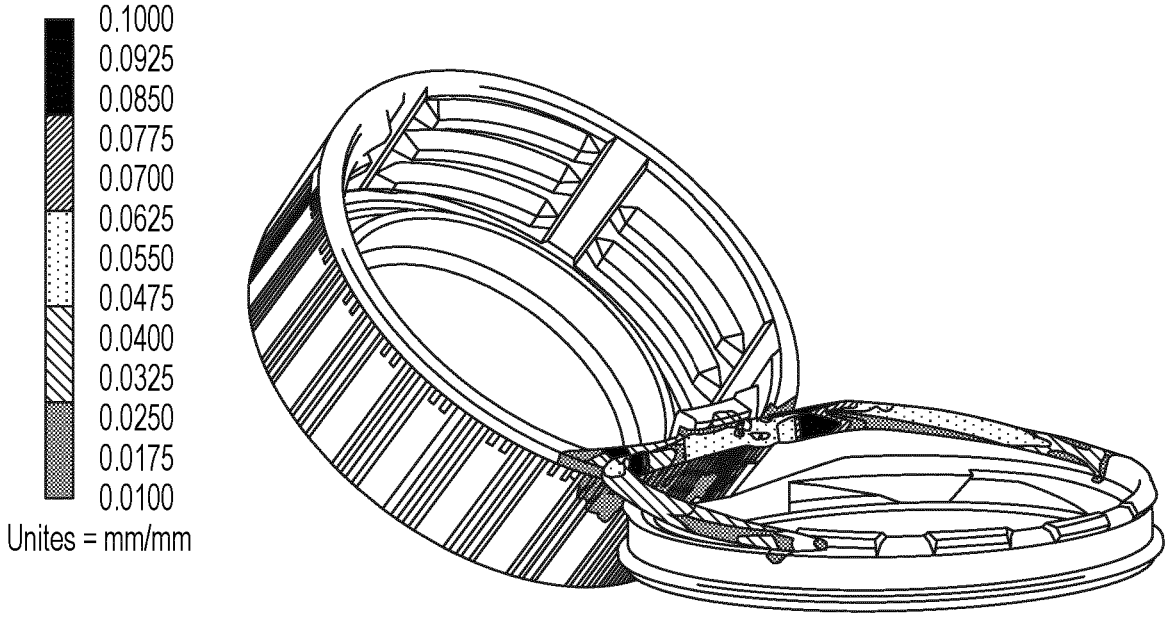
Figure 18A:
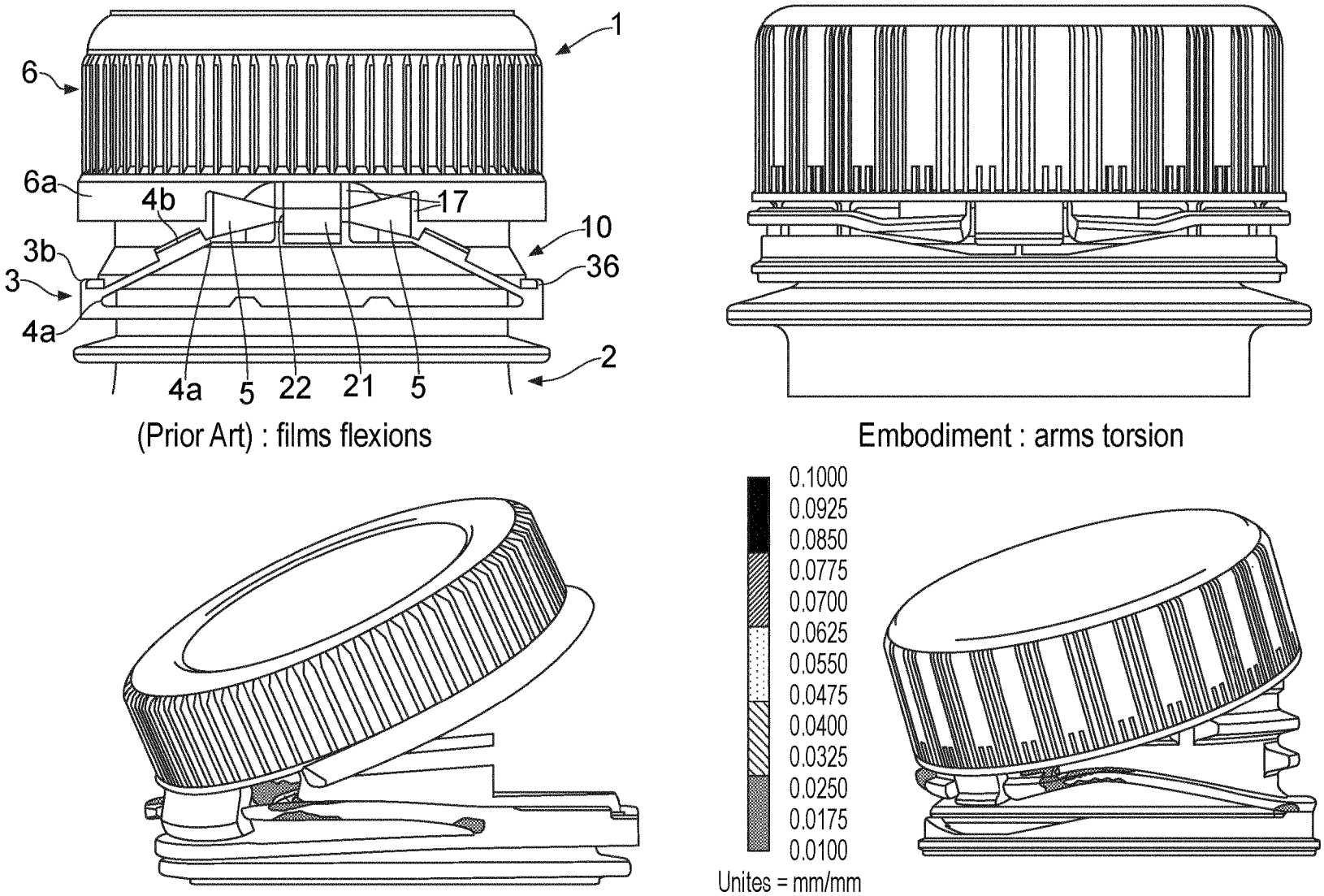
Figure 18B:
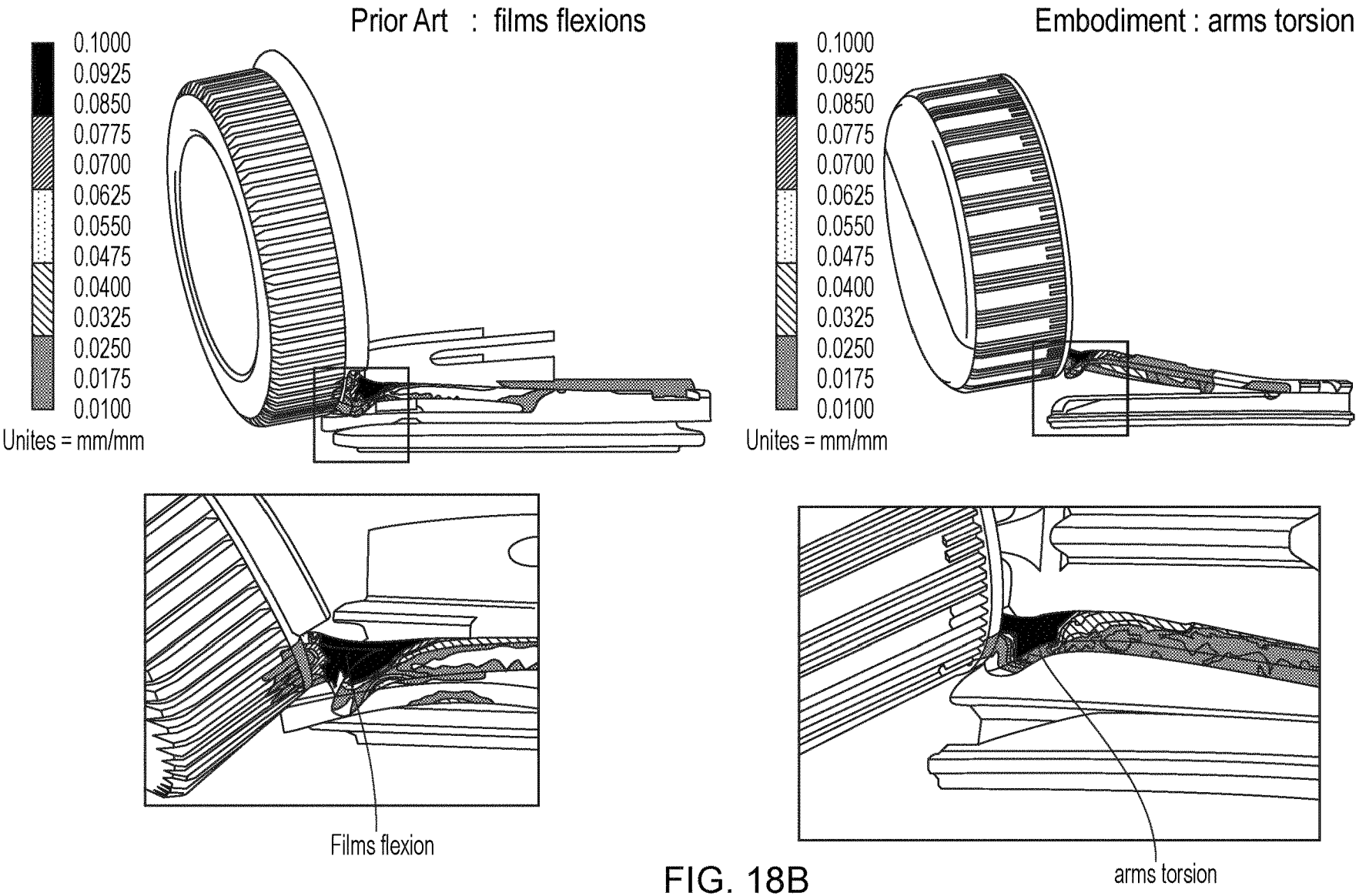
Figure 18C:
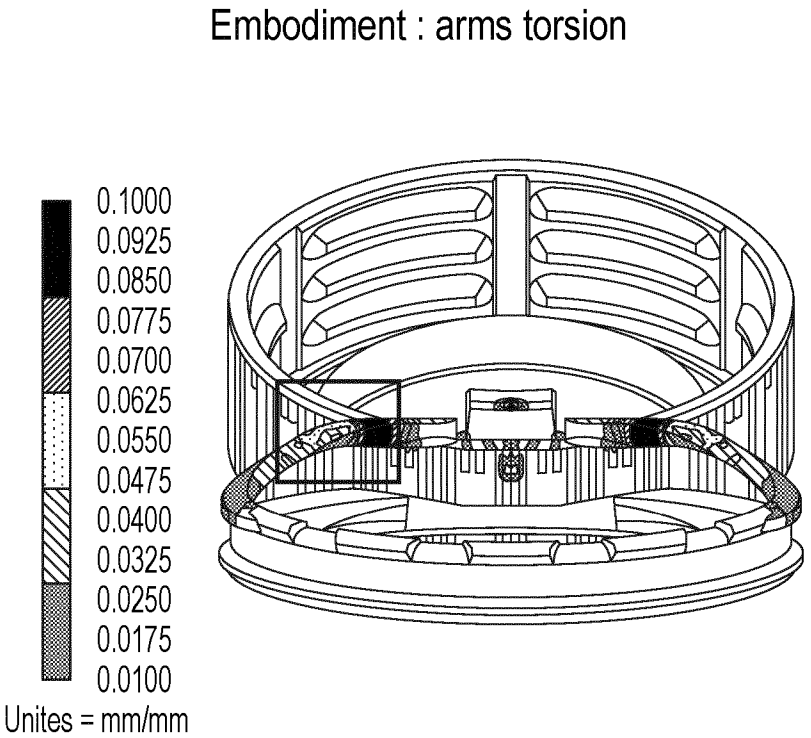
Figure 18C:
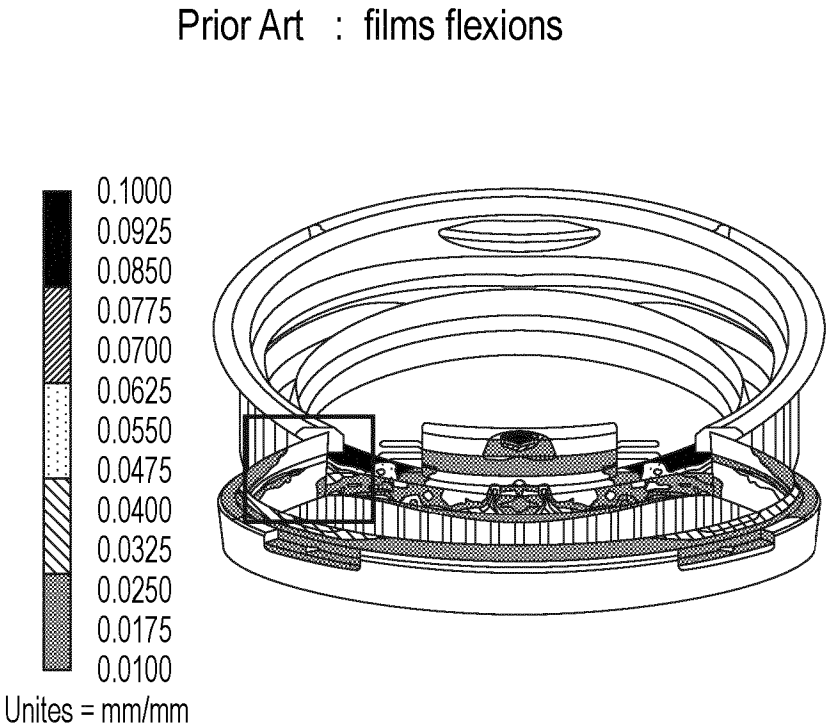
Figure 18D:
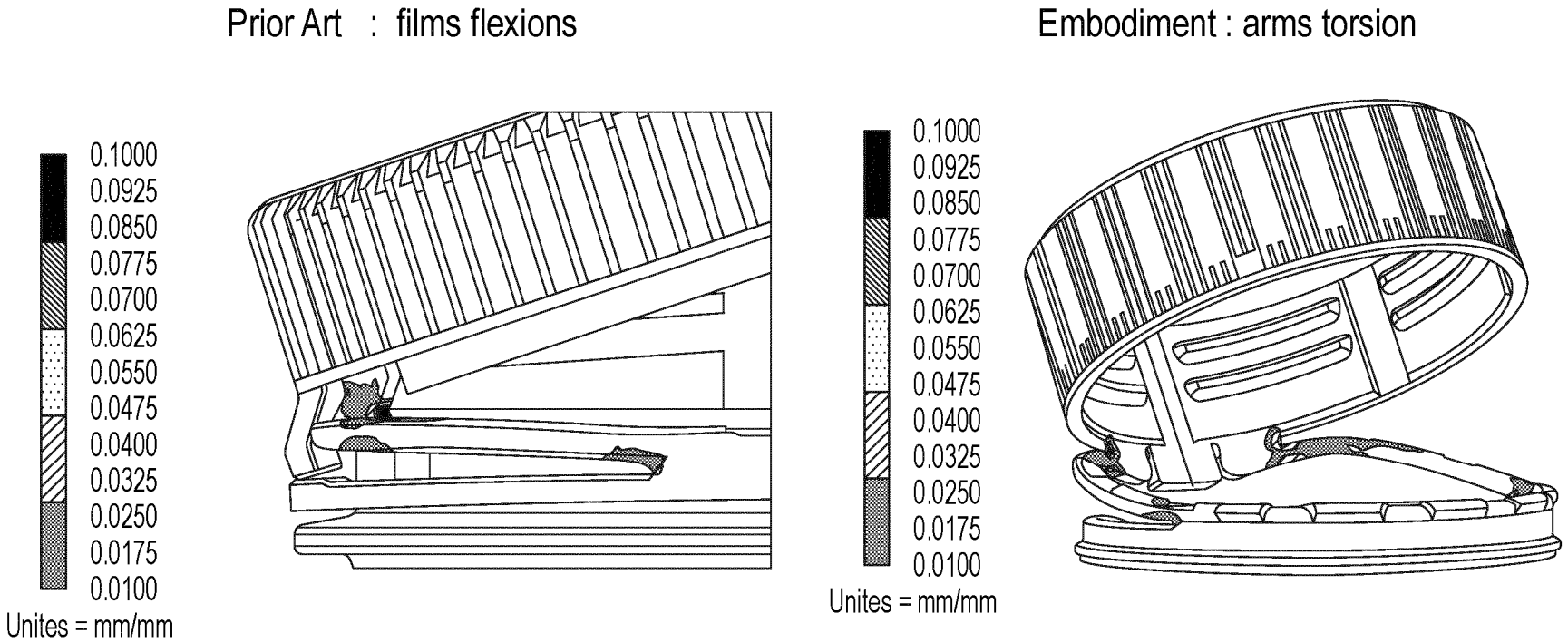

FIG. 13 shows the fully open position, with the tab resting on the neck, which holds the cap in a stable position.

The open position of a closure is also illustrated in FIGS. 14 to 17.

Some other features/advantages of aspects and embodiments of the present invention include:

- the thin webs have a real hinge function.
- the flexible area is not inclined but aligned vertically.
- the flexible areas do bend but not as much and will transfer torsion to the connecting arms.
- the flexible areas are not positioned as high as possible inside the lid cap but in fact totally in the TE band.
- as a consequence the flexible areas are not positioned lower than the thread start.

Referring now to FIG. 18A to 18D there is shown a comparison between an embodiment of the present invention, being a carbonated soft drink closure of the type generally described above, and a known closure of the type as described in WO00/26108.

In the case of the embodiment the position of the hinge is off-set of 100% into the TE band, whereas in the prior art it is positioned partially in the closure shell.

FIGS. 18A to 18D show the different opening kinematic between the prior art closure and a closure formed in accordance with the present invention. The opening sequences show how the arms are twisted during opening of the present invention, which is different to the prior art closure, where the thin webs have a real hinge function.

Prior Art: essentially operates by flexion of the films. Flexion: the action of bending or the condition of being bent. The hinge is partly provided in the closure shell (as well as in the tamper-evident, tethering, retention band).

Embodiment: operates by torsion of the arms. Torsion: the action of twisting or the state of being twisted. The hinge is completely provided in the closure shell (and not at all in the tamper-evident, tethering, retention band).

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

What is claimed:

1. A closure connectable to a container neck, the closure comprising a cap and a retaining ring, the cap comprising a top plate and a sidewall that depends from the periphery of the top plate, at the free end of the sidewall the retaining ring is provided, the interior of the sidewall includes a screw thread formation that can engage a corresponding formation on the container neck, an internal annular seal depends from the underside of the top plate and fits into the bore of the container neck when the closure is in place and the cap is closed, an external annular seal also depends from the underside of the top plate and fits onto the outside of the container neck when the closure is in place and the cap is closed, the retaining ring includes an internal annular snap bead which can be positioned under a neck bead to prevent the retaining ring from being removed axially, the retaining ring comprising a first connecting arm and a second connecting arm, the first connecting arm is non-frangibly connected to the cap at a cap tether end and circumferentially anticlockwise therefrom is non-frangibly connected to the retaining ring at a ring root end, the second connecting arm is non-frangibly connected to the cap at a cap tether end and circumferentially clockwise therefrom is non-frangibly connected to the retaining ring at a ring root end, wherein each of the first and the second connecting arm is formed as a first linear portion that extends from the ring root end, an inclined portion, and a second linear portion, the second linear portions connect non-frangibly to the free end of the sidewall by thinned webs, between the cap tether ends of the first and second connecting arms a central tab is provided, the retaining ring has a cut-out to accommodate the first and second linear portions and the central tab, the cap can be tilted away from the retaining ring with the first and second connecting arms providing a hinge, and each of the first and second connecting arms twists between its cap tether end and its ring root end, whereby tension is generated in the first and second connecting arms, the position of the hinge provided by the first and second connecting arms is completely in the retaining ring structure and not in the closure cap, during the unscrewing the cap can lift vertically along the corresponding screw thread formation, to allow freedom to get access to a container, while still remaining tethered to the container.

2. A closure as claimed in claim 1, in which the axial extent of the sidewall is generally constant.

3. A closure as claimed in claim 1, in which the central tab depends from the cap.

4. A closure as claimed in claim 1, in which the central tab is generally inverted as the cap is tilted away from the retaining ring and rests on the container to hold the cap in an open position.

5. A closure as claimed in claim 1, in which the retaining ring is fitted to be freely rotatable on the container neck.

6. A closure as claimed in claim 1, in which the cap can be moved to a stable open position.

7. A closure as claimed in claim 6, in which the cap can be moved to the stable open position by being tilted away from the retaining ring through approximately 130-140 degrees of rotation.

8. A closure as claimed in claim 1, in which the first and second connecting arms hinge with respect to the sidewall as the cap tilts.

9. A closure as claimed in claim 1, in combination with a container.

10. A closure in combination with a container, the container is filled with a carbonated beverage, the container has a container neck, the closure is connected to the container neck, the closure comprises a cap and a retaining ring, the cap comprises a top plate and a sidewall that depends from the periphery of the top plate, at the free end of the sidewall a retaining ring is provided, the interior of the sidewall includes a screw thread formation that can engage a corresponding screw thread formation on the container neck, an internal annular seal depends from the underside of the top plate and fits into the bore of the container neck when the closure is in place and the cap is closed, an external annular seal also depends from the underside of the top plate and fits onto the outside of the container neck when the closure is in place and the cap is closed, the retaining ring includes an internal annular snap bead which can be positioned under a neck bead to prevent the retaining ring from being removed axially, the retaining ring comprises a first connecting arm and a second connecting arm the first connecting arm is non-frangibly connected to the cap at a cap tether end and circumferentially anticlockwise therefrom is non-frangibly connected to the retaining ring at a ring root end, the second connecting arm is non-frangibly connected to the cap at a cap tether end and circumferentially clockwise therefrom is non-frangibly connected to the retaining ring at a ring root end, wherein each of the first and the second connecting arm is formed as a first linear portion that extends from the ring root end, an inclined portion, and a second linear portion, the second linear portions connect non-frangibly to the free end of the sidewall by thinned webs, between the cap tether ends of the first and second connecting arms a central tab is provided, the retaining ring has a cut-out to accommodate the first and second linear portions and the central tab, the cap can be tilted away from the retaining ring with the first and second connecting arms providing a hinge, and each of the first and second connecting arms twists between its cap tether end and its ring root end, whereby tension is generated in the first and second connecting arms, the position of the hinge provided by the first and second connecting arms is substantially completely in the retaining ring structure and not in the closure cap, during the unscrewing the cap can lift vertically along said corresponding screw thread formation of the container neck, to allow freedom to get access to the container, while still remaining tethered to the container.

* * * * *